United States Patent [19]

Sano et al.

[11] Patent Number: 4,820,684

[45] Date of Patent: Apr. 11, 1989

[54] PRESSURE-SENSITIVE RECORDING SHEET

[75] Inventors: Shojiro Sano; Keiso Saeki, both of Shizuoka, Japan

[73] Assignee: Fuji Photo Film Co., Ltd., Kanagawa, Japan

[21] Appl. No.: 873,916

[22] Filed: Jun. 13, 1986

[30] Foreign Application Priority Data

Jun. 13, 1985 [JP] Japan ..... 60-129066

[51] Int. Cl.[4] ..... B41M 5/16; B41M 5/22

[52] U.S. Cl. ..... 503/212; 427/150; 427/152; 428/914; 503/208; 503/209; 503/216; 503/225

[58] Field of Search ..... 346/210–212, 346/216, 225; 427/150–152; 428/913, 914; 503/208, 209, 210–212, 216, 225

[56] References Cited

U.S. PATENT DOCUMENTS 3,157,526 11/1964 Johnson et al. ..... 503/211
4,287,264 9/1981 Marginean ..... 427/151
4,531,141 7/1985 Sagawa ..... 346/225

FOREIGN PATENT DOCUMENTS 4949593 3/1982 Japan ..... 530/209

*Primary Examiner*—Bruce H. Hess
*Attorney, Agent, or Firm*—Sughrue, Mion, Zinn, Macpeak & Seas

[57] ABSTRACT

A pressure-sensitive recording sheet is disclosed. The sheet produces a color image by reaction between a substantially colorless electron donating dye precursor and an electron accepting color developer, wherein a layer containing said electron accepting color developer contains (a) a metal salt of an aromatic carboxylic acid and (b) a zinc salt of dithiocarbamic acid represented by formula (I)

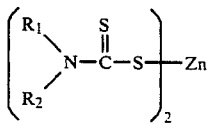

(I)

wherein $R_1$ and $R_2$ each represents an alkyl or aryl group.

25 Claims, No Drawings

PRESSURE-SENSITIVE RECORDING SHEET

FIELD OF THE INVENTION

The present invention relates to a pressure-sensitive recording sheet. More particularly, the present invention relates to a pressure-sensitive recording sheet which will produce a color image by means of reaction between a substantially colorless electron donating dye precursor (hereinafter referred to as a color former) and an electron accepting color developer (hereinafter referred to as a color developer).

BACKGROOUND OF THE INVENTION

Pressure-sensitive recording materials depend for their operation on a color-forming reaction between color formers and color developers such as clay materials (e.g., acid clay, activated clay, attapulgite, zeolite, bentonite and kaolin), metal salts of aromatic carboxylic acids, and phenol-formaldehyde resin. This type of recording material is well known and is described, for example, in U.S. Pat. Nos. 2,505,470, 2,505,489, 2,550,471, 2,548,366, 2,712,507, 2,730,456, 2.730,457, and 3,418,250; and Japanese Patent Application (OPI) Nos. 28411/74 and 44009/75 (the term "OPI" as used herein means an "unexamined published Japanese patent application").

The use of acid clay, activated clay and other clay minerals as color developers has the serious disadvantage that the color image which is obtained by causing them to react with color formers do not have satisfactory resistance to light or moisture. Attempts have been made to eliminate this drawback by using metallic compounds in combination with clay minerals. According to Japanese Patent Application (OPI) No. 49593/82, metal salts of dithiocarbamic acid are used in combination with clay mineral based color developers with a view to providing a color image having improved resistance to both light and moisture.

Metal salts of aromatic carboxylic acids employed as color developers will produce color images that compare favorably with those resulting from clay minerals in terms of resistance to light and moisture. However, the metal salts of aromatic carboxylic acids are also defective in that the resulting color images have a smaller degree of fastness to plasticizers compared with those obtained from clay minerals.

SUMMARY OF THE INVENTION

The principal object, therefore, of the present invention is to provide a pressure-sensitive recording sheet which is capable of producing a color image having a markedly improved resistance to light and plasticizers.

This object of the present invention can be attained by a pressure-sensitive recording sheet having a layer of an electron accepting color developer which contains (a) a metal salt of an aromatic carboxylic acid and (b) a zinc salt of dithiocarbamic acid represented by formula (I)

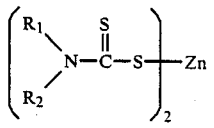

(I)

wherein $R_1$ and $R_2$ each represents an alkyl or aryl group.

DETAILED DESCRIPTION OF THE INVENTION

The alkyl group represented by $R_1$ and $R_2$ in formula (I) is preferably one having from 1 to 5 carbon atoms.

The aryl group denoted by $R_1$ and $R_2$ is preferably one having from 6 to 10 carbon atoms, with a phenyl or tolyl group being particularly preferred.

It is an entirely surprising discovery which could not be expected from the prior art to find that zinc dithiocarbamate has the ability to provide a color image having a markedly improved fastness to plasticizers, since the metal salt of an aromatic carboxylic acid which is used in combination with said zinc dithiocarbamate is not effective in this respect.

Dithiocarbamic acid may also form salts with lead, selenium, cadmium, zirconium, barium, magnesium, copper and tellurium, but only the zinc salt is capable of providing a color image with an appreciably improved resistance to plasticizers when it is used in combination with metal salts of aromatic carboxylic acids.

Examples of the metal salts of aromatic carboxylic acids that can be used in the present invention are described in U.S. Pat. Nos. 3,864,146 and 3,983,292, and Japanese Patent Application (OPI) No. 120010/79.

Useful aromatic carboxylic acids that can form salts with metals are those having a hydroxyl group in the position ortho or para to the carboxyl group. Salicylic acid derivatives are preferable, and particularly preferred are those which have a substituent such as an alkyl, aryl or arylkyl group in either the ortho or para position or both with respect to the hydroxyl group and which have a total of at least 8 carbon atoms in the substituent.

Particularly preferable aromatic carboxylic acids include 3,5-di-t-butylsalicylic acid, 3,5-di-t-amylsalicylic acid, 3,5-bis(α,α-dimethylbenzyl)salicylic acid, 3,5-bis(αmethylbenzyl)salicylic acid, 3-(α-methylbenzyl)-5-(α,α-dimethylbenzyl)salicylic acid, 3,5-di-t-octylsalicylic acid, and 3-cyclohexyl-5-(α,α-dimethylbenzyl)salicylic acid.

Examples of the metals that can form salts with these aromatic carboxylic acids include magnesium, aluminum, calcium, scandium, titanium, vanadium, chromium, manganese, iron, cobalt, nickel, copper, zinc, potassium, germanium, strontium, yttrium, zirconium, molybdenum, cadmium, indium, tin, antimony, and barium. Among these metals, zinc, aluminum, and calcium are preferable, with zinc being particularly preferable.

The following compounds are preferred examples of the zinc salts of dithiocarbamic acid which are suitable for use in the present invention.

(i) zinc dimetyldithiocarbamate;
(ii) zinc diethyldithiocarbamate;
(iii) zinc dipropyldithiocarbamate;
(iv) zinc dibutyldithiocarbamate;
(v) zinc diamyldithiocarbamate; and
(vi) zinc N-ethyl-N-phenyldithiocarbamate.

The zinc salts of dithiocarbamic acid are preferably used in amounts ranging from 5 to 100 wt %, based on the weight of metal salt of aromatic carboxylic acids present.

The zinc salts of dithiocarbamic acid are used after they are dispersed in aqueous media with the aid of a Kady mill, ball mill, attritor, or a sand mill. The zinc salts of dithiocarbamic acid may be dispersed in the form of mixtures with metal salts of aromatic carboxylic acids.

The metal salts of aromatic carboxylic acids are used in the form of a dispersion or emulsion. Dispersions of the metal salts of aromatic carboxylic acids can be obtained by dispersing them in aqueous media by means of mechanical treatment with a ball mill, attritor, or a sand mill. Emulsions of the metal salts of aromatic carboxylic acids may be obtained by first dissolving them in organic solvents and then emulsifying the solutions in water. Usable organic solvents are those which have the ability to dissolve at least 10 wt % of the metal salts of aromatic carboxylic acids, and illustrative examples are aliphatic or aromatic esters, biphenyl derivatives, naphthalene derivatives and diphenylaklanes.

The dispersions and emulsions of the metal salts of aromatic carboxylic acids may be used after being mixed in appropriate proportions.

Coating solutions of the color developer may contain inorganic pigments such as titanium oxide, zinc oxide, silicon oxide, calcium oxide, calcium carbonate, aluminum hydroxide, kaolin, activated clay, talc, and barium sulfate and these pigments are effective in providing desirable effects such as improvement in adaptability to coating and hiding power, as well as in color developing ability. Dispersing such inorganic pigments with the aid of media-using dispersers such as a sand mill, ball mill, and an attritor is also desirable in that improvements are attained in terms of color developing ability and the quality of coated surface. The inorganic pigments are desirably used in amounts ranging from 1 to 100 parts, more preferably from 2 to 50 parts, per 100 parts by weight of the metal salt of an aromatic carboxylic acid.

The thus-prepared coating solution of color developer is applied to a support after a binder has been added. Usable binders include lattices such as a styrene-butadiene copolymer latex, and synthetic or natural high-molecular weight substances such as polyvinyl alcohol, maleic acidstyrene copolymer, starch, casein, gum arabic, gelatin, carboxymethyl cellulose, and methyl cellulose.

The metal salts of aromatic carboxylic acids are coated onto a support in a final amount which ranges typically from 0.1 to 3.0 g/m$^2$, preferably from 0.2 to 1.0 g/m$^2$.

Although there is no particular limitation on the color former which reacts with the metal salts of aromatic carboxylic acids used in the recording sheet of the present invention, typical examples of the compounds that may be used as the color former include triarylmethane based compounds, diphenylmethane based compounds, xanthene based compounds, thiazine based compounds, spiro based compounds, and mixtures thereof.

The color former used in the present invention is coated onto a support in the form of either an encapsulated solution in a solvent or a dispersion in a binder solution. Suitable solvents are natural or synthetic oils which may be used either independently or in combination. More specific examples of the solvent include cottonseed oil, kerosene, paraffin, naphthenic oil, alkylated biphenyl, alkylated terphenyl, chlorinated paraffin, alkylated naphthalene and diphenylalkanes.

Microcapsules containing the color former may be prepared by various techniques such as interfacial polymerization, matrix polymerization, phase separation, in-situ polymerization, and coacervation.

The coating solution of the microcapsules containing the color former typically contains water-soluble binders or latex-based binders. The solution may also contain capsule protecting agents such as a cellulose powder, starch particles or talc.

The performance of the pressure-sensitive recording sheet coated with a color developer was tested using a sheet coated with microcapsules containing a color former, said sheet being prepared by the following procedures.

Preparation of sheet coated microcapsules containing a color former

Five parts of a partial sodium salt of poly(vinylbenzenesulfonic acid) (VERSA TL 500 of National Starch Co., with av. mol. wt. 500,000) was added to 95 parts of hot water (ca. 80° C.) under agitation. In about 30 minutes, a solution formed and it was subsequently cooled. The pH of the aqueous solution, which was initially 2 - 3, was increased to 4.0 by addition of sodium hydroxide (20 wt % aq. sol.). In the next step, 100 parts of diisopropylnaphthalene having 2.5 wt % of crystal violet lactone and 1.0 wt % of benzyl leucomethylene blue dissolved therein was dispersed in 100 parts of the 5% aqueous solution of partial sodium salt of poly(vinylbenzenesulfonic acid), thereby producing an emulsion having an average particle size of 4.5 μm. In a separate step, a mixture of melamine (6 parts), a 37 wt % aqueous solution of formaldehyde (11 parts) and water (30 parts) was agitated at 60° C. for 30 minutes to make a clear aqueous solution of a mixture of melamine, formaldehyde, and an initial condensation product of melamine and formaldehyde. The resulting aqueous solution had a pH within the range of 6 to 8. This solution of a mixture of melamine, formaldehyde, and an initial condensation product of melamine and formaldehyde is hereunder referred to as the solution of initial condensate. It was then added to the separately prepared emulsion, and the pH of the mixture was adjusted to 6.0 by addition of 3.6 wt % aqueous HCl under agitation. After increasing the temperature of the mixture to 65° C., agitation was continued for 360 minutes. The resulting solution of capsules was cooled down to room temperature and its pH adjusted to 9.0 by addition of 20 wt % sodium hydroxide.

To the thus-prepared dispersion of capsules, 200 parts of a 10 wt % aqueous solution of polyvinyl alcohol and 50 parts of starch particles were added, and the solids content of the mixture was adjusted to 20% by addition of water.

The thus obtained coating solution of microcapsules containing the color former was air knife coated to a base paper (TAPPI basis weight: 50 g/m$^2$) in an amount of 5 g/m$^2$ on a dry basis, and the web was dried to provide a sheet coated with microcapsules containing the color former.

The following examples are provided for the purpose of further illustrating the color developer sheet of the present invention for pressure-sensitive recording but it should be understood that the invention is in no way limited by these examples.

EXAMPLE I-1

Preparation of Emulsion:

Ten parts of zinc 3,5-bis(α-methylbenzyl)salicylate was added to 20 parts of 1-isopropylphenyl-2-phenylethane and the mixture was heated to 90° C. to form a solution. The solution was added to 50 parts of a 2% aqueous solution of polyvinyl alcohol (PVA-205 of Kuraray). After adding 0.1 part of sodium sulfosuccinate (10% aq. sol.) as a surfactant, the mixture was homogenized to form an emulsion (A) having an average particle size of 3 μm. An average particle size was measured by Coulter Counter.

Preparation of Dispersion

A mixture of zinc 3,5-bis( -methylbenzyl)salicylate (5 parts), zinc dimethyldithiocarbamate (3 parts), calcium carbonate (170 parts), zinc oxide (20 parts), sodium hexametaphosphate (1 part) and water (200 parts) was dispersed uniformly with a sand grinder to form a dispersion (A) having an average particle size of 3 μm.

Preparation of Coating Solution

To a mixture of 40 parts of the emulsion (A) and 200 parts of the dispersion (A), 100 parts of a 10% aqueous solution of PVA-110 (Kuraray) and 10 parts (on a solid basis) of a carboxy-modified SBR latex (SN-304 of Sumitomo Naugatuck Co., Ltd.) were added. Water then was added to make a coating solution with a solids content of 20%.

Preparation of Color Developer Sheet

The thus-prepared coating solution was air knife coated onto a base paper (TAPPI basis weight: 50 $g/m^2$) in an amount of 5.0 $g/m^2$ (on a dry basis) and the web was dried to form a color developer sheet.

EXAMPLE I-2

A color developer sheet was prepared as in Example I-1 except that 3 parts of the zinc dimethyldithiocarbamate employed in the "Preparation of Dispersion" was replaced by 3 parts of zinc diethyldithiocarbamate.

EXAMPLE I-3

A color developer sheet was prepared as in Example I-1 except that 3 parts of the zinc dimethyldithiocarbamate employed in the "Preparation of Dispersion" was replaced by 3 parts of zinc N-ethyl-N-phenyldithiocarbamate.

EXAMPLE I-4

A color developer sheet was prepared as in Example I-1 except that 170 parts of the calcium carbonate employed in the "Preparation of Dispersion" was replaced by a mixture of calcium carbonate (150 parts) and activated clay (20 parts).

COMPARATIVE EXAMPLE I

A color developer sheet was prepared as in Example I-1 except that no zinc dimethyldithiocarbamate was used in the "Preparation of Dispersion".

EXAMPLE II

Preparation of Dispersion

A mixture of zinc 3,5-di-t-butylsalicylate (15 parts), zinc diethyldithiocarbamate (3 parts), calcium carbonate (170 parts), zinc oxide (20 parts), sodium hexametaphosphate (1 part) and water (200 parts) was dispersed uniformly with a sand grinder to form a dispersion (B) having an average particle size of 3 μm.

Preparation of Coating Solution

To 400 parts of the dispersion (B), 100 parts of a 10% aqueous solution of PVA (degree of saponification, 99%; degree of polymerization, 1,000) and 10 parts (on a dry basis) of a carboxy-modified SBR latex were added. Water then was added to make a coating solution with a solids content of 20%.

Preparation of Color Developer Sheet

The thus-prepared coating solution was air knife coated onto a base paper (TAPPI basis weight: 50 $g/m^2$) in an amount of 5.0 $g/m^2$ (on a dry basis) and the web was dried to form a color developer sheet.

COMPARATIVE EXAMPLE II

A color developer sheet was prepared as in Example II except that no zinc diethyldithiocarbamate was used in the "Preparation of Dispersion".

COMPARATIVE EXAMPLE III

Two hundred parts of activated clay was dispersed in 800 parts of water. The pH of the dispersion was adjusted to 10.0 by addition of sodium hydroxide (20% aq. sol.), and to the thus adjusted dispersion, 40 parts (on a dry basis) of a styrene-butadiene copolymer latex (60 mol % styrene) and 60 parts of 10% aqueous starch were added. The resulting coating solution was air knife coated onto a base paper (TAPPI basis weight: 50 $g/m^2$) in an amount of 6 $g/m^2$ (on a dry basis) and the web was dried to form a color developer sheet.

PERFORMANCE TESTS

(1) Color developing ability

The microcapsule-coated surface of the color former sheet was rested on the coated surface of each of the color developer sheets prepared in the Examples and Comparative Examples, and a load of 600 $kg/cm^2$ was applied to the upper surface to cause a color reaction. Ten minutes after the appearance of a color image, its density at 610 nm was measured with a Hitachi color analyzer to check the color developing ability of each color developer sheet.

(2) Resistance to light

Starting 10 minutes after the appearance of the color image, the color developer sheets were exposed under a fluorescent lamp in a fadeometer (33,000 lux) for 4 hours and the density at 610 nm of the color image on each sheet was measured. The lightfastness of each image was determined in terms of the ratio of the density after exposure to that before exposure.

(3) Resistance to plasticizer

A soft poly(vinyl chloride) sheet 0.5 mm thick which contained 15 wt % of dibutyl phthalate and 7 wt % of octyl phthalate as plasticizers was superimposed on each of the color developer sheets 10 minutes after the appearance of a color image. The assembly was left for 72 hours in a hot dry atmosphere (50° C.×20% RH) under a load of 100 $g/m^2$. Then, the density at 610 nm of the color image on each color developer sheet was measured. The resistance of each image to the plasticizers was determined in terms of the ratio of the density after contact with the poly(vinyl chloride) sheet to that before contact.

The results of the measurements are shown in Table 1.

TABLE 1

| Run No. | | Color developing ability | Lightfastness | Resistance to plasticizer |
|---|---|---|---|---|
| Example | I-1 | 1.01 | 0.80 | 0.76 |
| | I-2 | 1.02 | 0.82 | 0.81 |
| | I-3 | 1.02 | 0.82 | 0.77 |
| | I-4 | 1.01 | 0.80 | 0.77 |
| Comparative Example I | | 1.01 | 0.80 | 0.42 |
| Example II | | 0.97 | 0.77 | 0.75 |
| Comparative Example II | | 0.96 | 0.76 | 0.37 |
| Comparative Example III | | 0.90 | 0.38 | 0.60 |

As Table 1 shows, the color developer sheets prepared in accordance with the present invention produce color images which are more resistant to light and plasticizers than those obtained from the comparative samples.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet which produces a color image by reaction between a substantially colorless electron donating dye precursor and an electron accepting color developer, said sheet comprising a support and an electron accepting color developer consisting essentially of (a) a metal salt of an aromatic carboxylic acid and (b) a zinc salt of dithiocarbamic acid represented by formula (I)

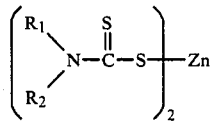

(I)

wherein $R_1$ and $R_2$ each represents an alkyl or aryl group; and wherein said metal salt of an aromatic carboxylic acid is a zinc, aluminum, or calcium salt.

2. A pressure-sensitive recording sheet as in claim 1, wherein $R_1$ and $R_2$ in formula (I) each represents an alkyl group having from 1 to 5 carbon atoms or said aryl group having from 6 to 10 carbon atoms.

3. A pressure-sensitive recording sheet as in claim 2, wherein said metal salt of an aromatic carboxylic acid is a zinc, aluminum, or calcium salt.

4. A pressure-sensitive recording sheet as in claim 2, wherein said metal salt of an aromatic carboxylic acid is a zinc salt.

5. A pressure-sensitive recording sheet as in claim 2, wherein said zinc salt of dithiocarbamic acid represented by formula (I) is selected from the group consisting of zinc dimethyldithiocarbamate, zinc diethyldithiocarbamate, zinc dipropyldithiocarbamate, zinc dibutyldithiocarbamate, zinc dimyldithiocarbamate, and zinc N-ethyl-N-phenyldithiocarbamate.

6. A pressure-sensitive recording sheet as in claim 2, wherein said zinc salt of dithiocarbamic acid represented by formula (I) is used in an amount of from 5 to 100 wt %, based on the weight of metal salt of aromatic carboxylic acid present.

7. A pressure-sensitive recording sheet as in claim 1, wherein $R_1$ and $R_2$ in formula (I) each represents an alkyl group having from 1 to 5 carbon atoms.

8. A pressure-sensitive recording sheet as in claim 1, wherein $R_1$ and $R_2$ in formula (I) each represents an aryl group having from 6 to 10 carbon atoms.

9. A pressure-sensitive recording sheet as in claim 8, wherein $R_1$ and $R_2$ each represents a phenyl or tolyl group.

10. A pressure-sensitive recording sheet as in claim 1, wherein said metal salt of an aromatic carboxylic acid is a zinc salt.

11. A pressure-sensitive recording sheet as in claim 1, wherein said zinc salt of dithiocarbamic acid represented by formula (I) is selected from the group consisting of zinc dimethyldithiocarbamate, zinc diethyldithiocarbamate, zinc dipropyldithiocarbamate, zinc dibutyldithiocarbamate, zinc diamyldithiocarbamate, and zinc N-ethyl-N-phenyldithiocarbamate.

12. A pressure-sensitive recording sheet as in claim 1, wherein said zinc salt of dithiocarbamic acid represented by formula (I) is used in an amount of from 5 to 100 wt %, based on the weight of metal salt of aromatic carboxylic acid present.

13. A pressure-sensitive recording sheet as in claim 1, wherein said metal salt of an aromatic carboxylic acid is coated on a support in an amount of from 0.1 $g/m^2$ to 3.0 $g/m^2$.

14. A color developer sheet for a pressure-sensitive recording sheet which comprises a support and an electron accepting color developer, consisting essentially of (a) a metal salt of an aromatic carboxylic

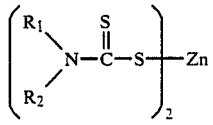

(I)

wherein $R_1$ and $R_2$ each represents an alkyl or aryl group; wherein said metal salt of an aromatic carboxylic acid is a zinc, aluminum or calcium salt.

15. A color developer sheet for a pressure-sensitive recording sheet as in claim 14, wherein $R_1$ and $R_2$ in formula (I) each represents an alkyl group having from 1 to 5 carbon atoms or an aryl group having from 6 to 10 carbon atoms.

16. A color developer sheet for a pressure-sensitive recording sheet as in claim 15, wherein said metal salt of an aromatic carboxylic acid is a zinc salt.

17. A color developer sheet for a pressure-sensitive recording sheet as in claim 15, wherein said zinc salt of dithiocarbamic acid represented by formula (I) is selected from the group consisting of zinc dimethyldithiocarbamate, zinc diethyldithiocarbamate, zinc dipropyldithiocarbamate, zinc dibutyldithiocarbamate, zinc dimyldithiocarbamate, and zinc N-ethyl-N-phenyldithiocarbamate.

18. A color developer sheet for a pressure-sensitive recording sheet as in claim 15, wherein said zinc salt of dithiocarbamic acid represented by formula (I) is used in an amount of from 5 to 100 wt %, based on the weight of metal salt of aromatic carboxylic acid present.

19. A color developer sheet for a pressure-sensitive recording sheet as in claim 14, wherein $R_1$ and $R_2$ in formula (I) each represents an alkyl group having from 1 to 5 carbon atoms.

20. A color developer sheet for a pressure-sensitive recording sheet as in claim 14, wherein $R_1$ and $R_2$ in formula (I) each represents an aryl group having from 6 to 10 carbon atoms.

21. A color developer sheet for a pressure-sensitive recording sheet as in claim 20, wherein $R_1$ and $R_2$ each represents a phenyl or tolyl group.

22. A color developer sheet for a pressure-sensitive recording sheet as in claim 14, wherein said metal salt of an aromatic carboxylic acid is a zinc salt.

23. A color developer sheet for a pressure-sensitive recording sheet as in claim 14, wherein said zinc salt of dithiocarbamic acid represented by formula (I) is selected from the group consisting of zinc dimethyldithiocarbamate, zinc diethyldithiocarbamate, zinc dipropyldithiocarbamate, zinc dibutyldithiocarbamate, zinc diamyldithiocarbamate, and zinc N-ethyl-N-phenyldithiocarbamate.

24. A color developer sheet for a pressure-sensitive recording sheet as in claim 14, wherein said zinc salt of dithiocarbamic acid represented by formula (I) is used in an amount of from 5 to 100 wt %, based on the weight of metal salt of aromatic carboxylic acid present.

25. A color developer sheet for a pressure-sensitive recording sheet as in claim 14, wherein said metal salt of an aromatic carboxylic acid is coated on a support in an amount of form 0.1 $g/m^2$ to 3.0 $g/m^2$.

* * * * *